US007539601B2

(12) United States Patent
Jaisinghani

(10) Patent No.: US 7,539,601 B2
(45) Date of Patent: May 26, 2009

(54) ENERGY EFFICIENT AIR HANDLING SYSTEM FOR CLEANROOMS

(76) Inventor: Rajan A. Jaisinghani, 13511 E. Boundary Rd., Suite D/E, Midlothian, VA (US) 23112-3941

( * ) Notice: Subject to any disclaimer, the term of this patent is extended or adjusted under 35 U.S.C. 154(b) by 604 days.

(21) Appl. No.: 11/246,954

(22) Filed: Oct. 11, 2005

(65) Prior Publication Data

US 2007/0089854 A1 Apr. 26, 2007

(51) Int. Cl.
*G06F 17/50* (2006.01)
*F24F 13/00* (2006.01)

(52) U.S. Cl. ..... 703/1; 703/2; 703/7; 165/66; 62/3.3

(58) Field of Classification Search ..... 703/1, 703/2, 7; 62/3.2, 3.3; 165/66
See application file for complete search history.

(56) References Cited

U.S. PATENT DOCUMENTS 5,761,908 A * 6/1998 Oas et al. ..... 62/3.2
6,120,584 A * 9/2000 Sakata et al. ..... 96/135
6,684,939 B2 * 2/2004 Yeung ..... 165/54
2005/0000681 A1 1/2005 Gagnon et al.

* cited by examiner

*Primary Examiner*—Thai Phan
(74) *Attorney, Agent, or Firm*—Robert E. Bushnell, Esq.

(57) ABSTRACT

A refrigeration based air handling system design process for significant energy and cost savings in cleanroom and other applications requiring large air change rates is presented. The process utilizes a by pass around the air conditioning system, the ratio of bypass to air conditioning flow being such that minimal or no reheat of the air is required for applications having relative humidity (RH) control requirements and with RH control being achieved via cooling. If dehumidification is achieved by adsorptive processes, then the by pass ratio is varied so as to minimize cooling of the heated dry air. In other non relative humidity control applications the bypass is varied to minimize the air conditioning flow, thereby decreasing cost, but by using optimum cooling coil velocities in a manner such that system energy for airflow is minimized. The energy and cost savings achieved by this process vary between 65% to 15% depending on the Class of the cleanroom and/or on the number of air changes per hour required.

18 Claims, 17 Drawing Sheets

FIG. 5
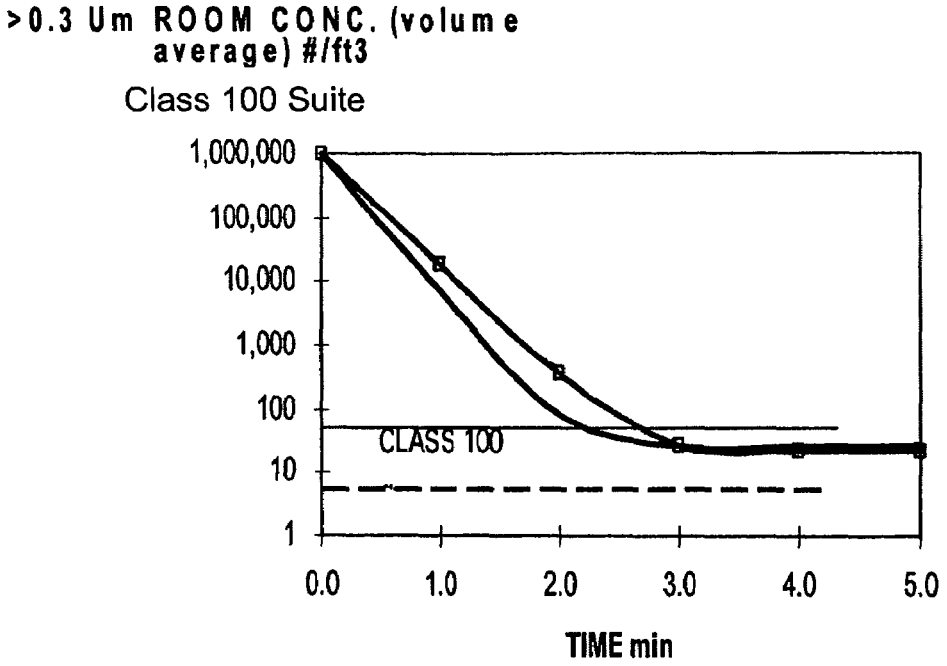
This graph shows the computer analysis (projected room performance.) the chart shows how fast a room cleans up after being initially contaminated. This is an important design parameter since there is always periodic step regression of contamination into the room.
DAH =EEF HEPA FILTERS +Terminal HEPAs
CAH w/ TERMINAL HEPAs ONLY
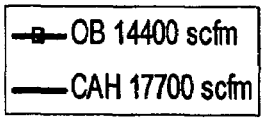

FIG. 7

| | CAH | | Technovation's OB system | |
|---|---|---|---|---|
| | Specification | Cost | Specification | Cost |
| Ductwork & rigging | 2346 Lbs G-90 galvanized steel class B | $15,327 | 2174 Lbs G-90 galvanized steel class B | $15,100 |
| Mezzanine | 190 SF | N/S | 195 SF | N/S |
| AHU | Huntair 19,000 CFM @ 4.5 "wg | $38,932 | Temtrol 8200 CFM @ 3.0 "wg | $20,600 |
| EEF Dist. Units | Not required | N/A | 6 units 2400CFM @ 1.5"wg each w/ 99.97% @ 0.3μm efficiency | $22,500 |
| HEPA terminal | 30 HEPA Slimline 99.99% @ 0.3μm w/ butterfly damper | $7,410 | 28 HEPA Slimline 99.99% @ 0.3μm w/ butterfly damper | $6,916 |
| CHW valve station | 2 1/2" piping w/ 91.2 gpm | N/S | 2" piping w/ 43.2 gpm | N/S |
| Electric reheat coil | 60 KW | $7,500 | 30 KW | Incl. |
| Electric panel & wiring | Reheat & AHU fan = 75KW, 100A breaker | N/S | Reheat & AHU fan & BP = 50KW, 60A breake | N/S |
| Total | | $69,169 | | $65,116 |

FIG. 8

| | Description | Energy Consumption (kWh/Yr.) | Mid Atlantic @ 7.4c/kWh Cost ($/Yr.) | NE @ 12.0c/kWh Cost ($/Yr.) | California @ 12.0c/kWh Cost ($/Yr.) |
|---|---|---|---|---|---|
| Cooling | 38TR @ 0.65KW/TR | 151,460 | $11,147 | $18,175 | $20,296 |
| Reheat coil | 53 KW | 324,996 | $23,920 | $39,000 | $43,549 |
| AHU Fan power | BHP 18.64 w/ motor eff. 90% | 135,237 | $9,953 | $16,228 | $18,122 |
| BP Fan power | N/A | 0 | $0 | $0 | $0 |
| Maintenance | | | | | |
| Filters cost | HEPA Terminals, 95% DOP, 30% Prefilte | | $3,910 | $3,910 | $3,910 |
| Labor | HEPA 2 day crew, 95% 2.5 hrs, Prefilters | | $963 | $963 | $963 |
| Total | | 611,694 | $49,893 | $78,276 | $86,839 |

FIG. 9

| | Description | Energy Consumption (kWh/Yr.) | Mid Atlantic @ 7.4c/kWh Cost ($/Yr.) | NE @ 12.0c/kWh Cost ($/Yr.) | California @ 13.4c/kWh Cost ($/Yr.) |
|---|---|---|---|---|---|
| Cooling | 18TR @ 0.65KW/TR | 71,744 | $5,280 | $8,609 | $9,614 |
| Reheat coil | 40 KW | 26,280 | $1,934 | $3,154 | $3,522 |
| AHU Fan power | BHP 6.6 w/ 90% Efficiency | 47,859 | $3,522 | $5,743 | $6,413 |
| BP Fan power | 6 units 2.0 HP 85% Eff | 92,135 | $6,781 | $11,056 | $12,346 |
| Maintenance | | | | | |
| Filters cost | HEPA Terminals, 95% DOP, 30% Prefilte | | $1,220 | $1,220 | $1,220 |
| Labor | 95% 2.5 hrs, Prefilters 1 hr | | $363 | $363 | $363 |
| Total | | 238,018 | $19,101 | $30,145 | $33,477 |

FIG. 11
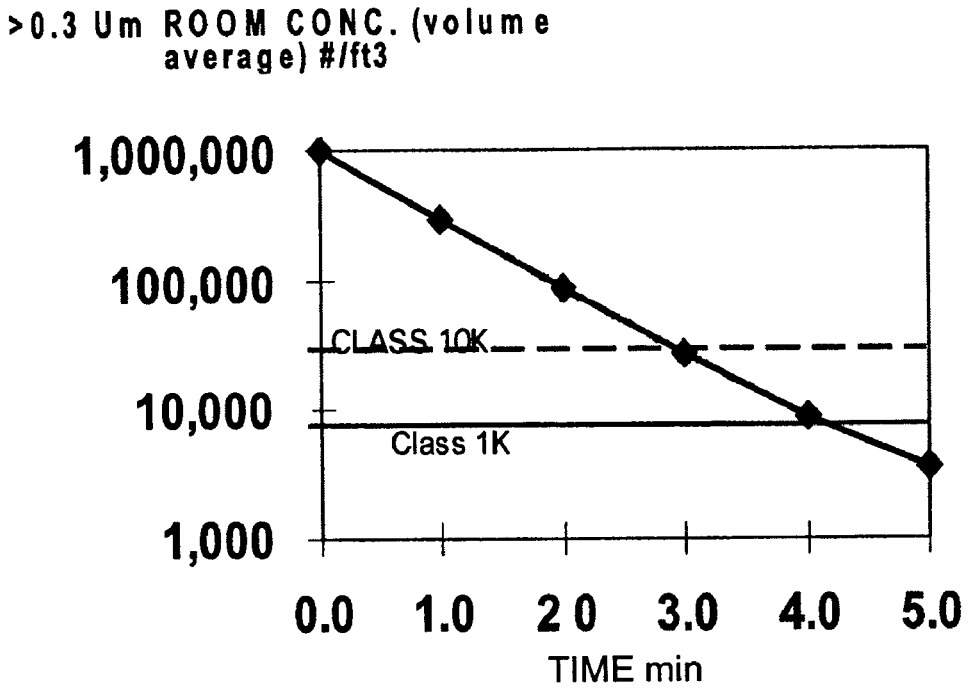
This graph shows the computer analysis (projected room performance.) the chart shows how fast a room cleans up after being initially contaminated. This is an important design parameter since there is always periodic step regression of contamination into the room.
DAHw/ EEF & TERMINAL HEPAs
CAHw/ TERMINAL HEPAs ONLY
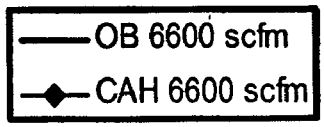

FIG. 14

| | CAH | | OB | |
|---|---|---|---|---|
| | Specification | Cost | Specification | Cost |
| Ductwork & rigging | 1620 Lbs G-90 galvanized st | $10,580 | 1456 Lbs G-90 galvanized steel | $9,512 |
| Mezz. | 190 SF | N/S | 195 SF | N/S |
| AHU | Huntair 6600 CFM @ 4.5 "wg | $19,659 | Temtrol 4500 CFM @ 4 "wg | $8,500 |
| EEFs BIO PLUS | Not required | N/A | 3 units 2400CFM @ 1.5"wg each w/ 99.97% @ 0.3µm efficiency | $11,250 |
| HEPA terminal | 12 HEPA Slimline 99.99% @ 0.3µm w/ butterfly damper | $2,964 | 12 HEPA Slimline 99.99% @ 0.3µm w/ butterfly damper | $2,964 |
| CHW valve station | 1 1/2" piping w/ 30 gpm | N/S | 1 1/2" piping w/ 25.6 gpm | N/S |
| Electric reheat coil | 30 KW | $3,951 | 20 KW | Incl. |
| Electric panel & wirin | Reheat & AHU fan = 40KW, 5 | N/S | Reheat & AHU fan & BP = 25KV | N/S |
| Total | | $37,154 | | $32,226 |

FIG. 15

| | Description | Energy Consumption (kWh/Yr.) | Mid Atlantic @ 7.4c/kWh Cost ($/Yr.) | N.E. @ 12.0c/kWh Cost ($/Yr.) | California @ 13.4c/kWh Cost ($/Yr.) |
|---|---|---|---|---|---|
| **Cooling** | 12.4TR @ 0.65KW/TR | 49,424 | $3,638 | $5,931 | $6,623 |
| **Reheat coil** | 12 KW | 73,584 | $5,416 | $8,830 | $9,860 |
| **AHU Fan power** | BHP 6.59 w/ motor eff. 90% | 47,786 | $3,517 | $5,734 | $6,403 |
| **BP Fan power** | N/A | 0 | $0 | $0 | $0 |
| **Maintenance** | | | | | |
| Filters cost | HEPA Terminals, 95% DOP, 30% Prefilter | | $1,760 | $1,760 | $1,760 |
| Labor | HEPA 1 day crew, 95% 1.5 hrs, Prefilters 1 hr | | $638 | $638 | $638 |
| **Total** | | 170,794 | $14,968 | $22,893 | $25,284 |

FIG. 16

| | Description | Energy Consumption (kWh/Yr.) | Mid Atlantic @ 7.4c/kWh Cost ($/Yr.) | N.E. @ 12.0c/kWh Cost ($/Yr.) | California @ 13.4c/kWh Cost ($/Yr.) |
|---|---|---|---|---|---|
| Cooling | 11TR @ 0.65KW/TR | 43,844 | $3,227 | $5,261 | $5,875 |
| Reheat coil | 20 KW | 13,140 | $967 | $1,577 | $1,761 |
| AHU Fan power | BHP 5.4 w/ motor eff. 90% | 39,157 | $2,882 | $4,699 | $5,247 |
| BP Fan power | 3 units 2.0 HP 85% Efficiency | 46,067 | $3,391 | $5,528 | $6,173 |
| Maintenance | | | | | |
| Filters cost | HEPA Terminals, 95% DOP, 30% Prefilter | | $610 | $610 | $610 |
| Labor | 95% 1.5 hrs, Prefilters 1 hr | | $363 | $363 | $363 |
| Total | | 142,208 | $11,439 | $18,037 | $20,028 |

ENERGY EFFICIENT AIR HANDLING SYSTEM FOR CLEANROOMS

BACKGROUND OF THE INVENTION

1. Technical Field

This application pertains to heating, ventilating and air conditioning systems and processes generally, and, more particularly, to energy efficiency in heating, ventilating and air conditioning systems and air handling processes for clean rooms and other environmentally controlled spaces that require large air change rates.

2. Description of Related Art

In air handling systems applicable to cleanrooms and other applications requiring large air exchange rates, the air is cooled to meet the sensible heat load of the cleanroom. If the cleanroom or other enclosed environment is to have relative humidity (RH) control in addition to a large air exchange rate, and if dehumidification is achieved by cooling, then the air is cooled to a dew point corresponding to the required moisture content level by allowing the excess moisture to condense on the cooling coils of the air conditioning system. Typically, this means that the air leaving the cooling coil would be too cold for the cleanroom environment. In other words, in such a dehumidification system, the air has been cooled to a temperature that is in excess of the sensible heat load of the environmentally controlled space. Therefore, the air leaving the cooling coil must be re-heated to the required temperature. If however, dehumidification is achieved by adsorptive processes, the air is heated due to heat of adsorption and must then be cooled down to meet the sensible heat load of the cleanroom. Other systems, such as the damper system of Martin Gagnon, et alii, in the Air Handling Systems Or Devices Intermingling Fresh And Stale Air assigned Ser. No. 10/903010 and filed in the U.S. Patent & Trademark Office on the $2^{nd}$ of Aug. 2004, Pub. No. 2005/0000681 dated on the $6^{th}$ of Jan. 2005, exhaust a portion of the stale air from the enclosure to create a reduced stale air stream, and create a mixed or intermingled air stream by introducing an amount of fresh air into the reduced stale air stream.

I have found that both the cooling of the air to a dew point corresponding to the required moisture content level followed by reheating in dehumidification processes, as well as the heating of the air to achieve adsorption followed by cooling of the air in an adsorption process, are inefficient and unnecessarily expensive in terms of the energy consumed. Although a by pass of airflow may occur around the air conditioning unit of an air handling unit in these processes, the by pass is incidental and no process has been able to optimize energy savings and minimize or eliminate reheating by harnessing a by pass of air flow during the air handling process.

SUMMARY OF THE INVENTION

It is therefore one object of the present invention to provide a more efficient refrigeration based air handling system exhibiting lower installation and operating costs.

It is another object to provide an air handling process and system dedicated to optimization of the energy consumed.

It is still another object to provide an air handling process and system endowed with an ability to minimize, or to eliminate, the use of energy to reheat the air.

It is yet another object to attain an optimization of energy used by an air handling process by controlling a by pass of airflow around the ACU.

It is still yet another object to minimize or even eliminate reheating of the air flow from an air handling unit.

It is a further object to provide optimization of energy used during air handling for environmentally controlled enclosed volumes by harnessing a by pass of air around the air conditioning unit of an air handling system.

These and other objects may be achieved with a refrigeration based air handling system design process for significant energy and cost savings in clean room and other environmentally controlled applications of enclosed volumes requiring large air change rates. The process utilizes an air flow by pass around the air conditioning system, with the ratio of bypassed air flow to air conditioned flow being established to necessitate minimal or no reheat of the combined bypassed and conditioned air flow required for applications having relative humidity control requirements, and with relative humidity control being achieved via cooling.

When dehumidification is achieved by adsorptive processes, the bypass ratio is varied so as to minimize cooling of the heated dry air. In other non-relative humidity control applications the bypass is varied to minimize the air conditioning flow, thereby decreasing cost, but with optimum cooling coil velocities in a manner that minimizes consumption of energy necessary to maintain airflow through the system.

An energy efficient dehumidification systems may be constructed to service a clean room environment by providing a combined make up air and return air flow entering the dehumidification system, then joining, or mixing, the combined make up air and return air exiting the dehumidification system with an air flow from another branch, or with return air, that has bypassed the dehumidification system, and adjusting the airflow rate of the combined make up air and return air and the airflow rate of the air drawn from the other branch in order to maintain the dew point to assure dehumidification approximately equal to the supply air temperature necessary to overcome the sensible heat load within the clean room.

The energy and cost savings achieved by this process vary between 15% and 65%, depending on the class of the cleanroom and on the number of air changes per hour required.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 5 is a two coordinate graph illustrating the amount of airflow required for the suite of FIG. 3 for the central air handling system in comparison with an optimized bypass system equipped with a double HEPA filter system and constructed according to the principles of the present invention;

FIG. 7 is an itemized comparison between the installation costs for a suite of FIG. 3 of a central air handling system and an optimized bypass system constructed according to the principles of the present invention;

FIG. 8 is an itemized comparison of the operational costs for a suite of FIG. 3 equipped with a central air handling system, in three different economic zones;

FIG. 9 is an itemized comparison of the operational costs for a suite of FIG. 3 equipped with an optimized bypass system constructed according to the principles of the present invention in the same economic zones represented by FIG. 8;

FIG. 11 is a two coordinate graph illustrating the amount of airflow required for the single clean room of FIG. 10, for the central air handling system in comparison with an optimized bypass system constructed according to the principles of the present invention;

FIG. 14 is an itemized comparison, for a single cleanroom, between the installation costs of a central air handling system and an optimized bypass system constructed according to the principles of the present invention;

FIG. 15 is an itemized comparison of the operational costs for a single clean room of FIG. 10 equipped with a central air handling system, in three different economic zones; and FIG. 16 is an itemized comparison of the operational costs for a single clean room of FIG. 10 equipped with an optimized bypass system constructed according to the principles of the present invention in the same economic zones represented by FIG. 8.

DETAILED DESCRIPTION

Figure 1:
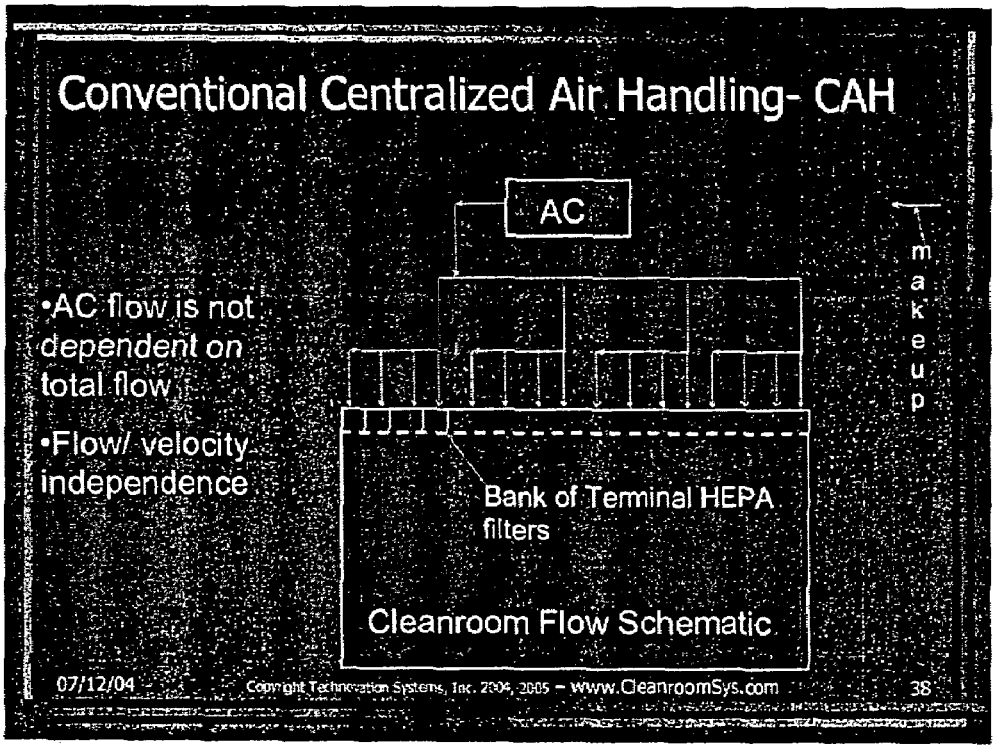
FIG. 1 is a clean room flow schematic of a central air handling system most commonly used in clean rooms.

Turning now to the drawings, FIG. 1 illustrates an airflow schematic in a system that relies upon dehumidification by means of cooling; the most common air handling system used in cleanrooms is the central air handling (CAH) system—in this case the entire return airflow is circulated through a central air handler. In this system the return air, known as the re-circulated air, is mixed with the make up air which is drawn either from the outer environment or from a first stage make up air conditioning unit. The combined return air and make up air is then conditioned for both moisture content (relative humidity (i.e., also known as "RH")) and temperature. In central air handling systems, the supply air must be at a temperature suitable to meet the sensible heat load of the clean room (i.e., the clean room is an environmentally controlled space). The air is cooled to a dew point corresponding to the required moisture content level, and the excess moisture condensed on the cooling coils of the air conditioning system. Typically, this means that the air leaving the cooling coil would be too cold for the environment (i.e., the air has been cooled in excess of the sensible heat load of the environmentally controlled space). Therefore, the air leaving the cooling coil must be re-heated to the required temperature. This process in essence, requires an excessive cooling of the combined return air and make up air, followed by reheating of the combined air, a process which consumes substantial energy.

Another kind of system utilizes fan filter units (FFU) operated in conjunction with fan tower units or return chase fans. In such systems, the entire airflow rate is typically passed through the air conditioning unit (ACU). Sometimes however, part of the air is bypassed depending on the characteristics of the air conditioner and the amount of negative pressure, or suction, that the FFUs can create. Although there may be a by pass of airflow around the ACU, no process has been presented or published to enable optimization and energy savings due to this by pass because this type of system lacks either a feature endowing the system with an optimization of the energy consumed or with any aspect to either minimize or eliminate the energy necessary to reheat the air.

Figure 2A:
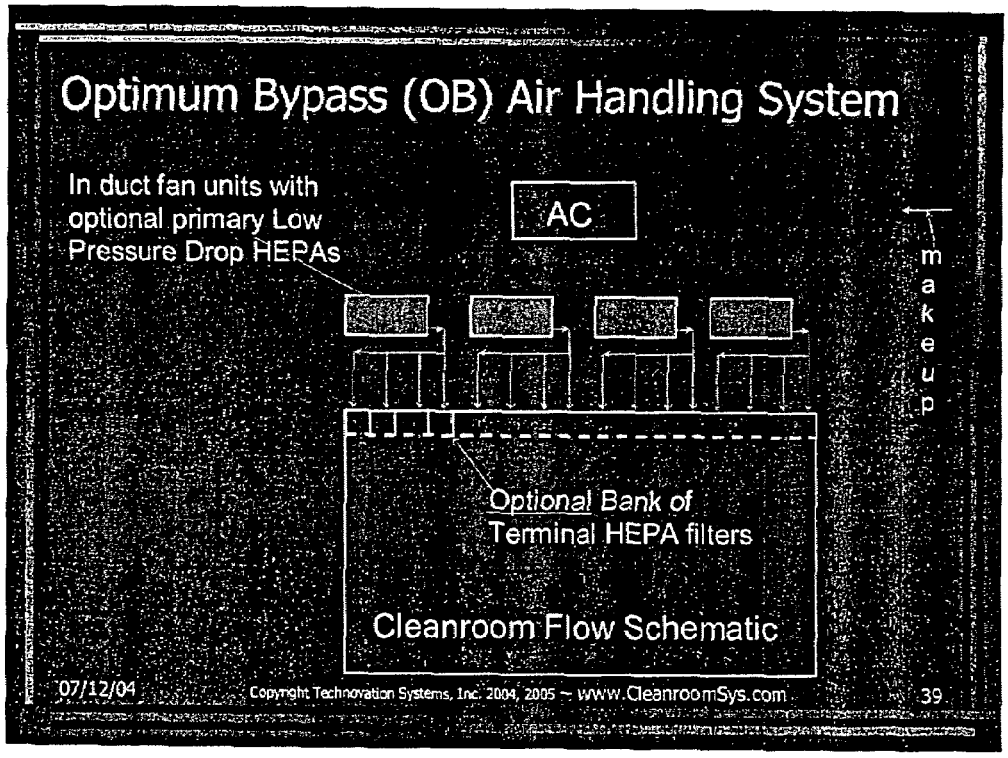
FIG. 2A is a schematic diagram illustrating the airflow for one embodiment of an optimized bypass schematic airflow in a dehumidification process using cooling with multiple bypass in line fan/filter units.
Figure 2B:
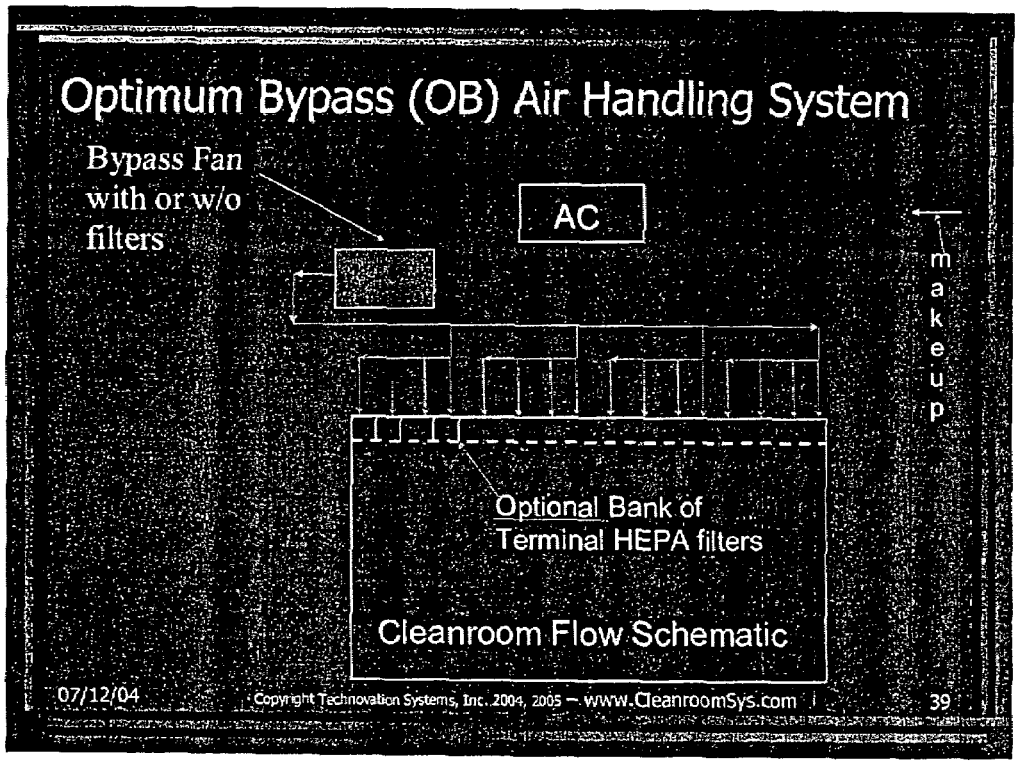
FIG. 2B is a schematic diagram illustrating the airflow for one embodiment of an optimized bypass schematic airflow in a dehumidification process using cooling with a single bypass fan with and without filters.

FIGS. 2A and 2B show the OB process schematic airflow for dehumidification using cooling. This process determines an optimized amount of airflow bypass around the ACU so as to (i) minimize the cooling required, (ii) to minimize the energy required for airflow circulation and, to (iii) minimize or eliminate the-reheat required in dew point cooling for relative humidity controlled applications. This is done by optimizing or varying the percentage of total return air that is bypasses the ACU, as demonstrated in the several examples described in detail in the following paragraphs. Examples of energy and cost savings achieved in RH controlled applications are also provided. The net result is anywhere from 15% to 65% savings in energy consumption in ISO (ISO Standard 14644-1) Class 1 through Class 9cleanrooms. The same benefit may be obtained in other clean environment applications such as bio-safety and other enclosed laboratories, hospital operating rooms, isolation rooms and in any building situation which requires large air change rates.

In FIG. 2A the OB system has multiple bypass in line fan and filter units. This gives the system flexibility in terms of modification and upgrading in the future as well as providing redundancy to prevent total failure of the system in case one of the fan motors fail. Typically, in such a configuration, the in line fan and filters are preferably, but not necessarily, selected from among those described by the Jaisinghani as electrically enhanced filters which have significantly lower pressure drop due to a reduced resistance of transient air flow. This then provides a practical and energy efficient way to provide double HEPA filtration, which has been shown to reduce the total amount of airflow required and thus the energy consumption in cleanrooms.

FIG. 2B illustrates an air handling system constructed with only one bypass fan, which may be equipped with one or more primary filters, or alternatively may be operated without any primary filter, in accordance with the principles of this invention. In some cases, it is convenient to simply use one fan instead of multiple fans as shown in FIG. 2A, especially if the units are to be roof mounted. Even in this case, the filters used may be as described by the Jaisinghani2 electrically enhanced filter patents which have significantly lower pressure drop due to a reduced resistance of air flow. This then provides a practical and energy efficient way to provide double HEPA filtration, which has been shown to reduce the total amount of airflow required and thus the energy consumption in cleanrooms.

If only temperature control and no dehumidification is required in an air handling system, the OB system can still reduce cost and increase efficiency, albeit to a lesser level. In the OB system, part of the returned air is bypassed. By varying the ratio of the bypass, optimum coil airflow velocities can be used for the cooling load, thereby making the system more efficient. Additionally, this process reduces the airflow through the normally restrictive heat transfer coils (the very fact that air is being bypassed achieves this), thus lowering the cost of moving air, and in turn also lowering the cost of the air conditioning unit, its weight as well as its installation costs which are directly proportional to the weight of the unit. For example, heavier units require more roof area and greater structural reinforcing members to support the system.

It should be noted that in both the conventional and the OB system, the amount of total airflow supplied to the cleanroom or other enclosed space is dictated by the size of the room, the operation to be conducted inside the room, and the cleanliness class of the cleanroom as per ISO 14644-11.

Consider first the process of dehumidification by means of cooling. The following equations describe the relationship between the airflow rates, temperatures and water concentration in the applications represented by FIGS. 2A through 4 collectively, which depict the airflow schematics of the OB process. These equations are based on simple stoichiometric or energy and material balance equations.

The supply air temperature, Ts necessary to meet the sensible heat load requirements of the cleanroom is given by:

$$Ts=Td-[Hp/(Qf*1.08)] \quad (1)$$

where Td=the design temperature in degrees ° F., Hp=the total sensible heat load measured in BTU/hr due to the process inside the room, and Qf is the total supply airflow rate, measured in standard cubic feet per minute (scfm), or as determined by other means based on the cleanliness class of the cleanroom as well as other process characteristics.

The supply water concentration in the moist air, Cs, is given by:

$$Cs=Cd-[W/(Qf*4.5)] \quad (2)$$

where Cd is the design concentration in pounds of water per pound of dry air, and W is the process moisture put into the air determined in pounds per hour (#/hr).

Working backwards along the supply airflow, the mixed (bypass plus air conditioned flow) air temperature, Tr, entering the fan filter units in the applications represented by FIGS. 2A through 4 is:

$$Tr=Ts-[Hf/(Qf*1.08)] \quad (3)$$

where Hf is the heat, determined in British thermal units (BTU/hr) added by the fans of the fan and filters units.

The water concentration at this same point, Cr is simply equal to Cs since no water has been added or removed as compared to the supply air.

$$Cr=Cs \quad (4)$$

Now the reheated air temperature, Trh, leaving the air conditioning unit is given by:

$$Trh=[(Ts-Td)*(1-fa))/fa]-[Hf/(Qf*1.08*fa)] \quad (5)$$

where the air conditioning flow ratio fa, is given by:

$$fa=Qa/Qf \quad (6)$$

where Qa is the airflow rate, in scfm (standard cubic feet per minute), through the air conditioning unit.

The water concentration, Crh=Ca (in pounds of water/pound of dry air) in the air conditioned supply air (prior to mixing with the return bypass) is then:

$$Ca=Crh=[(Cs-(1-fa))*Cd]/fa \quad (7)$$

The air temperature, Ti and water concentration, Ci, entering the air conditioning unit are given by:

$$Ti=[(1-fm)*Td]+[fm*Tm] \quad (8)$$

$$Ci=[(1-fm)*Cd]+[fm*Cm] \quad (9)$$

where fin is the ratio of make up airflow rate, Qm, to the total airflow rate, Qf:

$$fm=Qm/Qf \quad (10)$$

and Tm and Cm are the temperature and water concentration of the make up air respectively. Typically, either the design maximum or the 1% probability values are used for determining Tm and Cm for the area in which the cleanroom is to be constructed.

The value of Qm is determined by adding the process exhaust airflow rates to the leakage estimates for the cleanroom. Typically values of leakage are taken to be between 0.25-1 scfm per square footage of space, depending on room design pressures and quality of construction.

The air temperature and concentration leaving the air conditioning coils, under maximum load conditions and under the highest design values for Tm and Cm (design is always done for these maximum conditions) will be almost or fully saturated air (~100% RH) at the dew point corresponding to the desired value of Ca. We shall refer to this dew point temperature as Ta.

We are now in a position to define the highly energy efficient design process, eliminating or minimizing reheat energy, known as OB:

1. Td, Cd, Qm, Hf and Hp are known or are specified values for the design.
2. Qf is calculated by other means (cf. Jaisinghani 3)
3. Assume the value of the airflow rate, Qa, to be air conditioned.
4. Use equations 1-10 to calculate values of Ts, Cs, Tr, Cr, Trh, Ca, Crh, fm and fa.
5. Use psychometric charts for air, with Ta, the air temperature of air leaving the air conditioning coil or dew point, being determined after establishing the calculated values in step 4.
6. If the value of Trh is not equal to, or very close to, the dew point value of Ta, then repeat steps 3 to 6 (i.e. re-assume another value of Qa, noting that by changing this value the amount of bypass airflow rate and therefore the value of fa, is also being changed, because Qf is a constant).
7. When Trh~equals Ta, then make sure that this value of dew point is attainable with current air conditioning equipment and its practical restraints.

Although these processes describe the optimized bypass system, they are in fact general and cover conventional systems too—simply by setting the AC flow to a total flow ratio, Fr, of 1.

In order to understand the optimized process it is important first to analyze, design and compare a typical cleanroom application involving dehumidification and a cleanliness class of ISO 5 and then following this for an ISO 7, using both a Conventional CAH System and the OA system. These ISO classes are chosen since this is typically what is used in the biotech, life sciences, pharmaceutical, hospital, medical device and other industries, Part A—Example 1—ISO Class 5

Figure 3:
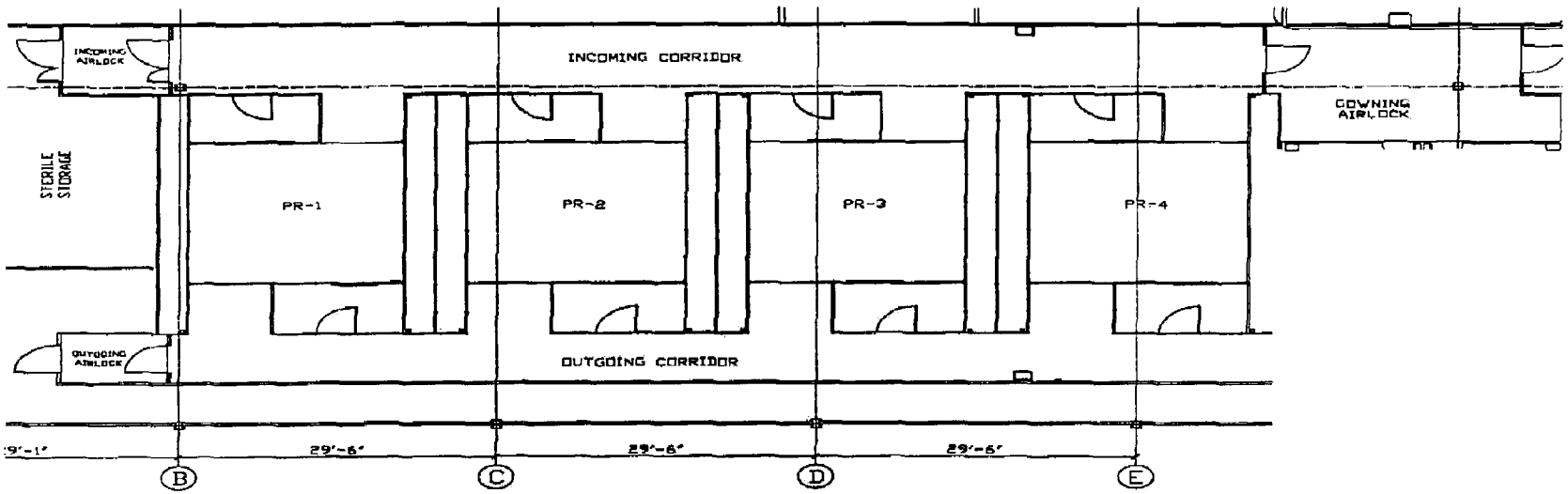
FIG. 3 is a plan view of a suite of multiple, discrete clean rooms arranged to prevent cross-contamination in an ISO Class 5 installation.

The cleanroom suite plan view is shown in FIG. 3. Please note that this figure shows multiple suites—all of which are identical and have separate air handling equipment so as to prevent cross contamination. The analysis here applies to only one suite. By applying the above equations 1-10 the following results for air conditioning are obtained for a 20'×20'×9' high cleanroom suite with incoming and outgoing vestibules—all connected to one air conditioning system.

The air conditioning design conditions are as follows:

Design Temp: 65° F.

Design (2 Stage) RH: 50%+5% max—no low end requirement

Make Up Air Conditions: 95 F. db/80 F. wb—this is conditioned to a dew point of 65° F. by means of a make up air handling unit that is common for both systems and hence is not part of the analysis.

Make up airflow rate: 500 scfm

Process Sensible Heat: 105832 BTU/hr

Process Latent Load: 8 #/hr

The amount of airflow required is calculated based on the process by Jaisinghani2 (see FIG. 5). The CAH system will require 17,700 scfm. The OB system used here for comparison, has a double HEPA filter system and hence requires somewhat less flow. If the single HEPA filter system comparison was used instead, the air conditioning advantage would actually be greater. However, for comparison purposes for the Class 5 case (Part A) we only have this comparison readily available. Note that for the Class 7 (Part B) comparison we do have available the same flow rate comparison. At any rate for the ISO Class 5 case the OB system requires 14,400 scfm to get the same performance as the CAH system using single HEPA filtration.

Figure 4:
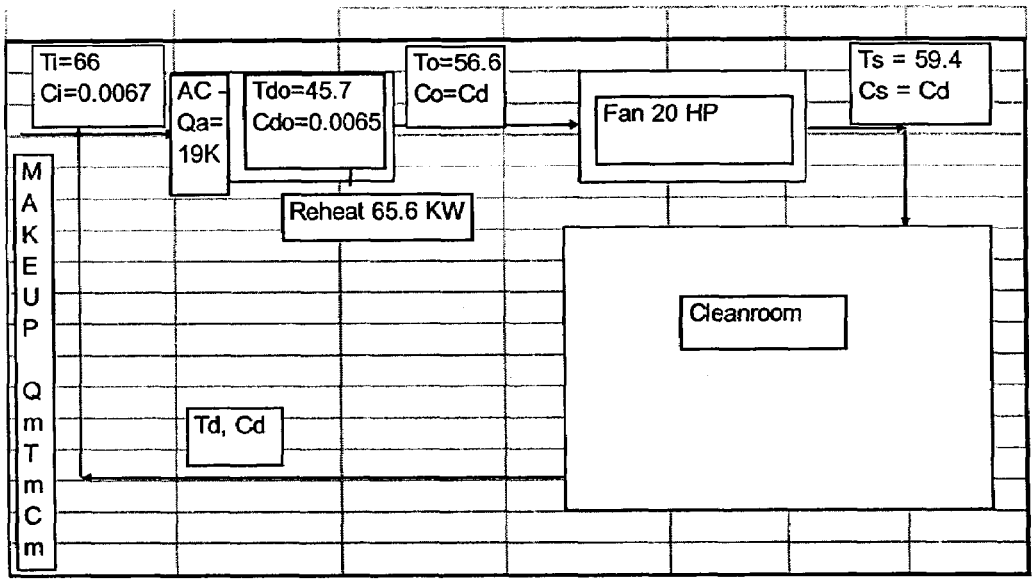
FIG. 4 is a schematic diagram illustrating process variables used for the design of the dehumidification process using a conventional central air handling system.

The FIG. 4 below shows the results of the calculations (equations 1-10) for the central air conditioning system (CAH):

In this case the system requires 65.6 KW of reheat to bring the temperature as required by the sensible heat load of the cleanroom after dehumidification. It should be noted that for the case of the CAH we have assumed only single final HEPA (high efficiency particulate air) filtration installed in the ceiling of the cleanroom.

Figure 6:
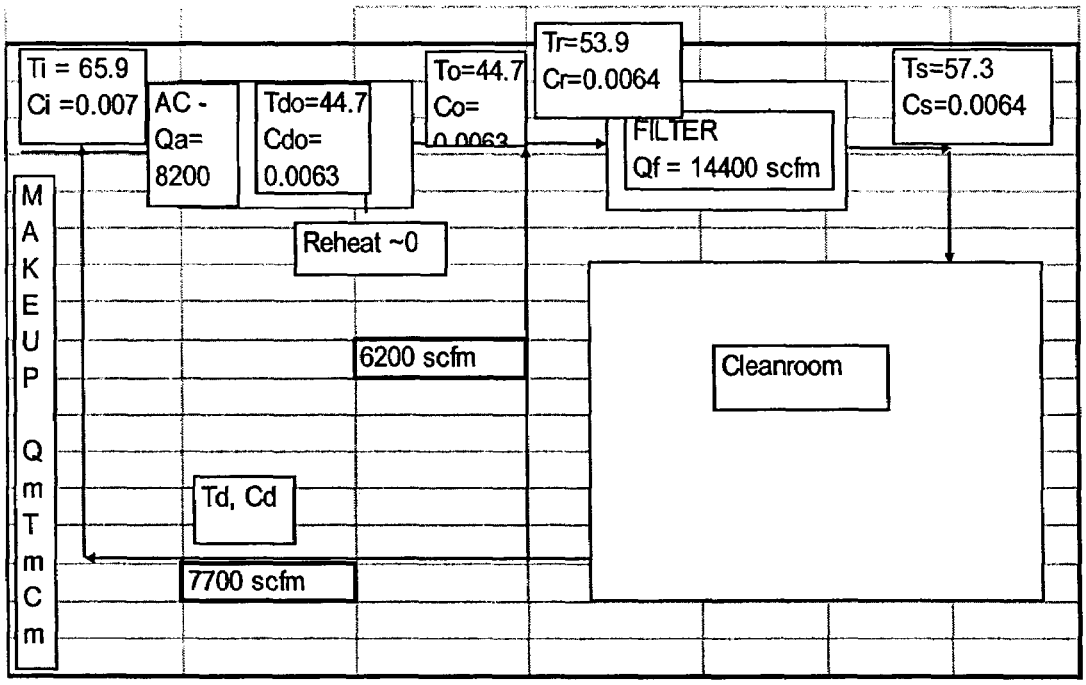
FIG. 6 is a schematic diagram illustrating process variables used for the design of the dehumidification process using an optimized bypass according to the principles of the present invention.

FIG. 6 below shows the results of the corresponding air conditioning calculations for the OB system.

In this case 6,200 scfm of the total airflow is bypassed around the air conditioner. This bypass air heats up the cooled (dehumidified to required dew point) air so as to eliminate the need for reheat except for a minimum amount as may be required for rigid temperature control purposes, within the tolerances required.

FIG. 7 below compares the initial costs associated with both the CAH and OB systems.

Clearly the OB system INITIAL or installed cost is lower (by about 5.7%) due to:

1. Lower cost of the air conditioning unit due to lower flow through the air conditioner resulting in smaller fans and motors and casing and weight.
2. Reheat coil required is much smaller.
3. Due to the by pass the total cooling capacity required is also significantly lower—18 tons versus 38 tons for the CAH system!
4. Part of this cost advantages is lost due to the use of the double HEPA system here.

FIGS. 8 and 9 below shows operating costs associated with the CAH and OB systems, respectively after eliminating the common components in the designs. The main common component is the make up air conditioning unit—identical for both. Note that the costs are computed for estimated electric power costs in (i) California, (ii) the North East of the US and (iii) the Mid Atlantic region of the US. These cost estimates are based on published values by EPRI (Electric Power Research Institute).

The results show that for this Class 5 application, the OB system:

saves about 50% of the operating costs as compared to the CAH system.

In dollars, per 20'×20' cleanroom suite, this translates to savings of about $31,000 for the Mid Atlantic region, $48,100 for the North East region and $53,300 for California.

Part B—Example 2—ISO Class 7

Figure 10:
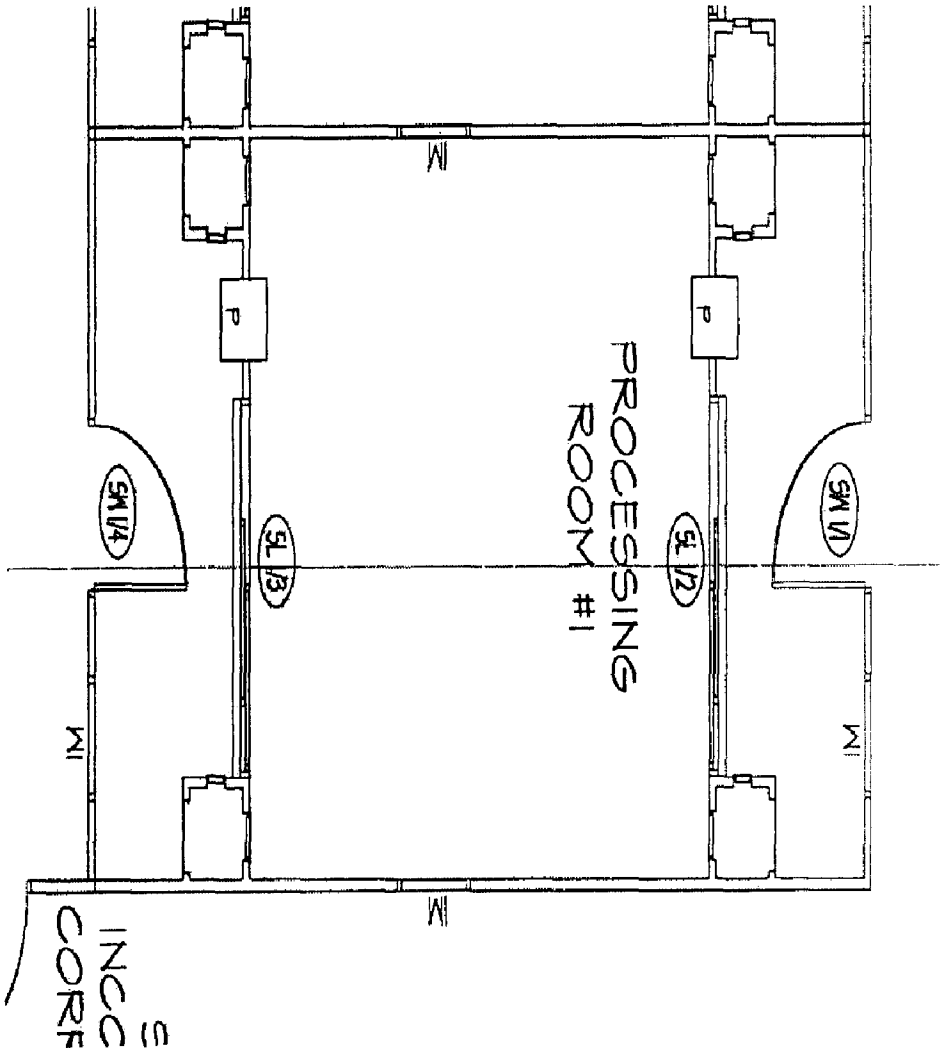
FIG. 10 is a plan view of a single clean room selected for an ISO Class 7 installation from a suite of clean rooms arranged to prevent cross-contamination.
Figure 12:
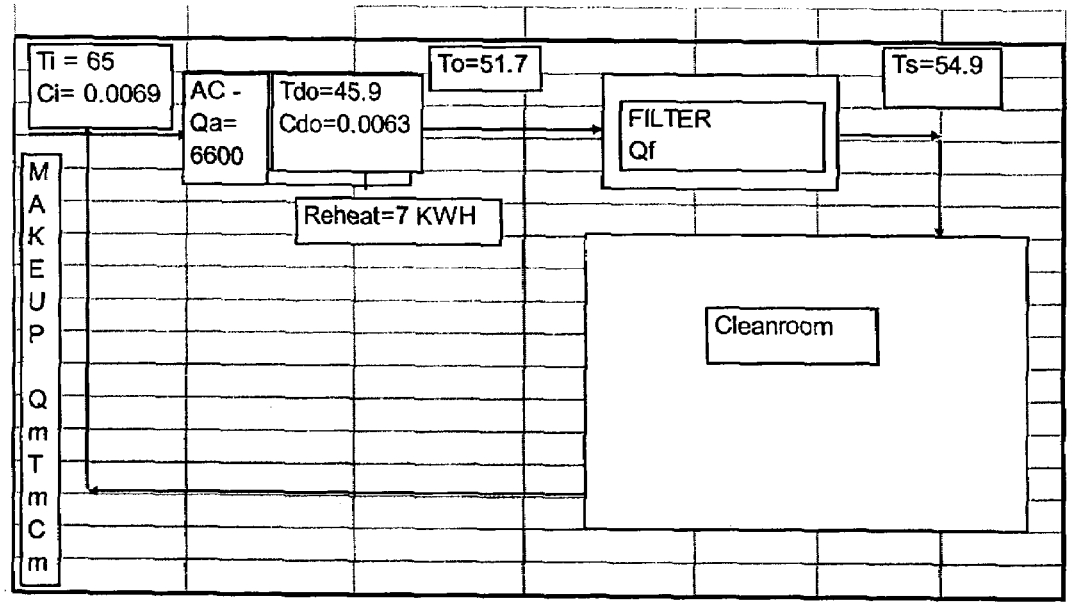
FIG. 12 is a schematic diagram illustrating process variables used for the design of the dehumidification process using a central air handling system.

The cleanroom suite plan view is shown in FIG. 10. By applying the above equations 1-10 the following results for air conditioning are obtained for a 20'×20'×9' high cleanroom suite with incoming and outgoing vestibules—all connected to one air conditioning system.

The air conditioning design conditions are as follows:

Design Temp: 65° F.

Design (2 Stage) RH: 50%+5% max—no low end requirement

Make Up Air Conditions: 95 F. db/80 F. wb—this is conditioned to a dew point of 65° F. by means of a make up air handling unit that is common for both systems and hence is not part of the analysis.

Make up airflow rate: 350 scfm

Process Sensible Heat: 55,951 BTU/hr

Process Latent Load: 8 #/hr

The airflow rate for both the CAH and OB systems is calculated once again using Jaisinghani2. FIG. 11 below shows that the CAH and OB system for this Class of room require the same airflow rate—6600 scfm.

Figure 13:
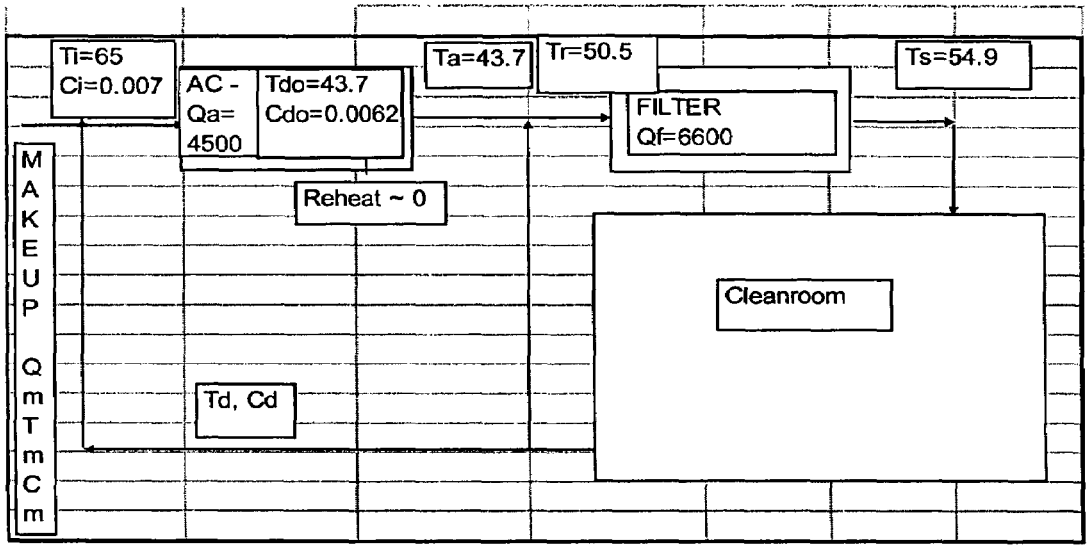
FIG. 13 is a schematic diagram illustrating process variables used for the design of the dehumidification process using an optimized bypass according to the principles of the present invention.

The Figure below shows the results of the calculations (equations 1-10) for the central air conditioning system (CAH):

In terms of reheat the CAH system requires about 7 KWH while the OB system requires essentially zero except for a minor amount for fine control of temperature. In order to achieve this result 1,100 scfm of air are by passed around the air conditioning unit. (FIG. 13)

FIG. 14 above compares the initial costs associated with both the CAH and OB systems. Clearly the OB system has a lower initial cost primarily due to savings associated with the size and lower flow of the air conditioner and somewhat lower ductwork and rigging cost.

FIGS. 15 and 16 below shows operating costs associated with the CAH and OB systems, respectively after eliminating the common components in the designs. The main common component is the make up air conditioning unit—identical for both. Note that the costs are computed for estimated electric power costs in (i) California, (ii) the North East of the US and (iii) the Mid Atlantic region of the US. These cost estimates are based on published values by EPRI (Electric Power Research Institute).

The results show that for this Class 5 application, the OB system:

saves about 22% of the operating costs as compared to the CAH system.

In dollars, per 20'×20' cleanroom suite, this translates to savings of about $3,600 for the Mid Atlantic region, $4,800 for the North East region and $5,300 for California.

The savings due to the OB system for the Class 10K application are lower than for is the Class 5 application due to the lower airflow required.

What is claimed is:

1. A process of designing energy efficient air handling for applications requiring relative humidity control, such that return air by passes part of the air going into the air conditioning system in a manner such that reheat of air is minimized and the size and cooling capacity of the air conditioning system is minimized, such that the amount of by pass air is determined in a manner such that the air exiting the dehumidifying air conditioner is at the approximately equal or is equal to the dew point required for dehumidification and such that this air after being mixed with the bypass air is at the required temperature to overcome the sensible heat load of the space.

2. The process of claim 1 with the following specific steps:

a. determining Td, Cd, Qm, Hf and Hp;

b. calculating Qf;

c. determining Qa;

d. calculating Ts, Cs, Tr, Cr, Trh, Ca, Crh, fm and fa;

e. determining Ta using psychometric charts and knowing the calculated values in step d;

f. repeating steps c to f when the value of Trh is not equal to or very close to the dew point value of Ta; and g. determining whether the value of Trh is attainable with current air conditioning equipment and its practical restraints when Trh equals or is very close to Ta.

3. The process of claim 2 with the bypass being accomplished by means of multiple fan units in parallel, each having a first stage filter or filters.

4. The process of claim 3 where the first stage filters are HEPA filters.

5. The process of claim 2, the calculating Ts, Cs, Tr, Cr, Trh, Ca, Crh, fm and fa being achieved by using the following equations:

$$Ts=Td-[Hp/(Qf*1.08)] \quad (1)$$

where Td=the design temperature in degrees ° F., Hp=the total sensible heat load measured in BTU/hr due to the process inside the room, and Qf is the total supply airflow rate, measured in standard cubic feet per minute (scfm);

$$Cs=Cd-[W/(Qf*4.5)] \quad (2)$$

where Cd is the design concentration in pounds of water per pound of dry air, and W is the process moisture put into the air determined in pounds per hour (#/hr);

$$Tr=Ts-[Hf/(Qf*1.08)] \quad (3)$$

where Hf is the heat, determined in British thermal units (BTU/hr) added by the fans of the fan and filters units;

$$Cr=Cs \quad (4);$$

$$Trh=[(Ts-Td)*(1-fa))/fa]-[Hf/(Qf*1.08*fa)] \quad (5)$$

where the air conditioning flow ratio fa;

$$fa=Qa/Qf \quad (6)$$

where Qa is the airflow rate, in scfm (standard cubic feet per minute) through the air conditioning unit;

$$Ca=Crh=[(Cs-(1-fa))*Cd]/fa \quad (7)$$

where the water concentration Crh=Ca (in pounds of water/pound of dry air) in the air conditioned supply air (prior to mixing with the return bypass);

$$Ti=[(1-fm)*Td]+[fm*Tm] \quad (8);$$

$$Ci=[(1-fm)*Cd]+[fm*Cm] \quad (9);$$

$$fm=Qm/Qf \quad (10)$$

where Tm and Cm are the temperature and water concentration ofthe make up air respectively.

6. The process of claim 1 with the bypass being accomplished by means of a fan unit.

7. The process of claim 1 with the bypass being accomplished by means of a fan unit which has a first stage air filter or multiple first stage air filters.

8. The process of claim 7 where the first stage filter consists of HEPA (High Efficiency Particle Air) filter or filters.

9. The process of claim 7 where the first stage filter is a HEPA (High Efficiency Particle Air) filter or filters and second stage or terminal HEPA filters are used in the ceiling of the controlled space.

10. The process of claim 1 with the bypass being accomplished by means of multiple fan units in parallel.

11. The process of claim 1 such that the first stage filters are Electrically Enhanced Filters.

12. The process of claim 11 such that the first stage EEFs have ultra low pressure drop.

13. The process of claim 11 where the first stage EEFs have bactericidal or bacterial growth inhibiting properties.

14. All these process being specifically applied to cleanrooms, bio safety labs, isolation rooms.

15. A method of conditioning air, comprising:

intaking air from a room into an air handling system;

splitting a flow of the incoming air into a first path and a second path;

removing moisture in air passing via said first path by cooling the air passing through said first path via an air conditioning unit;

mixing together air cooled in said first path with air passing through said second path; and discharging said mixed air back into said room.

16. The method of claim 15, said air passing via said second path bypassing said air conditioning unit and retaining moisture and temperature.

17. The method of claim 15, the first path comprising said air conditioning unit and the second path being absent of an air conditioning unit.

18. The method of claim 15, further comprising adding a makeup flow of air to the mixed air, the makeup flow originating from outside of the room.

* * * * *